US008926331B1

(12) United States Patent
Schlapik

(10) Patent No.: US 8,926,331 B1
(45) Date of Patent: Jan. 6, 2015

(54) TETHERED LED ILLUMINATED BALL

(76) Inventor: Kevin Schlapik, Fort Lauderdale, FL (US)

( * ) Notice: Subject to any disclaimer, the term of this patent is extended or adjusted under 35 U.S.C. 154(b) by 177 days.

(21) Appl. No.: 13/425,502

(22) Filed: Mar. 21, 2012

Related U.S. Application Data

(60) Provisional application No. 61/467,259, filed on Mar. 24, 2011.

(51) Int. Cl.
*A63H 33/22* (2006.01)

(52) U.S. Cl.
USPC ..... 434/219

(58) Field of Classification Search
USPC ..... 446/220, 228, 247, 252, 219; 473/570, 473/571, 576
See application file for complete search history.

(56) References Cited

U.S. PATENT DOCUMENTS

| | | | | |
|---|---|---|---|---|
| D309,475 | S * | 7/1990 | Salehzadeh et al. | D21/466 |
| 5,236,383 | A * | 8/1993 | Connelly | 446/219 |
| 5,399,136 | A * | 3/1995 | Bart | 482/110 |
| 5,492,335 | A * | 2/1996 | Videnov | 473/576 |
| 5,611,540 | A * | 3/1997 | Williams et al. | 473/429 |
| 6,776,679 | B1 * | 8/2004 | Menow | 446/236 |
| 6,837,808 | B1 * | 1/2005 | Hatch | 473/424 |
| 6,887,188 | B1 * | 5/2005 | Davies | 482/82 |
| 7,186,192 | B1 * | 3/2007 | Suissa | 473/423 |
| 7,361,074 | B1 * | 4/2008 | Periman et al. | 446/242 |
| 2002/0137582 | A1 * | 9/2002 | Yu | 473/570 |
| 2003/0027484 | A1 * | 2/2003 | Kessler | 446/247 |

* cited by examiner

*Primary Examiner* — Kurt Fernstrom
(74) *Attorney, Agent, or Firm* — H. John Rizvi; Gold & Rizvi P.A.

(57) ABSTRACT

The present invention is related to a tethered LED illuminated ball comprising a tether assembly and a soft compressible ball coupled therewith. A retention member having one or more loops is coupled to one end of the tether assembly. A swivel is coupled to the second end of the tether assembly and operatively coupled to the ball by a ball retention cord. An illumination assembly is coupled to the ball and provides various light emitting patterns. The illumination assembly is coupled adjacent to the ball retention cord. The illumination assembly includes at least one LED and a battery operatively coupled therewith.

20 Claims, 2 Drawing Sheets

TETHERED LED ILLUMINATED BALL

CROSS-REFERENCE TO RELATED APPLICATIONS

This Non-Provisional Utility Patent Application claims priority to U.S. Provisional Patent Application Ser. No. 61/467,259 filed on Mar. 24, 2011, which is incorporated herein in its entirety.

BACKGROUND OF THE INVENTION

1. Field of the Invention

The present invention relates generally to the field of entertainment devices. More particularly, the present invention is directed to a soft toy ball that has a tether attached thereto such that ball may be used in various activities such as juggling. The ball further has a light emitting diode (LED) and associated electronics such that the ball may be illuminated from within.

2. Description of the Prior Art

"Poi" is a Maori word for 'ball' on a cord. Poi was used, many years ago, by the indigenous Maori people of New Zealand to increase their flexibility and strength in their hands and arms as well as to improve coordination. Originally, these Poi balls were related to some dances performed by the Maori female dancers, using balls attached to flax strings, swung rhythmically. The purpose of this dance using balls was basically for keeping their hands flexible. Furthermore, Maori men used Poi and performed these dances for strength and coordination required during a battle. Poi is a form of juggling where the ball may be swung around the body for playing, dancing and exercising. In the beginning, Poi had the purpose of enhancing dance and rhythm. However, nowadays it is used for several different purposes, including not only entertainment but also for some health-related benefits like wrist strength, body flexibility and improving coordination.

Over time there have been several different types of Poi developed. Glow LED (light emitting diodes) lighted Poi: is a ball that includes a LED inside for providing a light feature that enhances the visual attraction of the product. There is a Fire Poi: involving a wick attached to several chains. This fire feature adds not only a visual impact on the user and the audience but also some risk during the spinning of the balls. A Fabric Poi: the balls are made of different types of soft fabrics using different attractive colors. Plastic bags, sponges and knitting wool may be used in making this type of Poi. A Pendulum contact Poi: this Poi set combines contact juggling style moves with regular Poi routines. Different airwraps, stalls, throws, floaters and pendulum routines can be created. A Tailed Poi: by adding comet tails the Poi ball and added effect of improving the plane control to prevent the tails tangling is obtained. A Sock Poi: instead of using cords, a pair of long knee high socks with a ball inside may also be used to create this type of Poi.

While these known devices are somewhat useful, they present several drawbacks. For example, these known Poi are generally fabricated of a hard plastic that may injure the user and cause bruising when hitting the body during the learning process of spinning the ball. Further, these known devices do not include an adjustable length cord and do not allow easy modifications of the cord to facilitate various spin motions. Finally these known devices generally have a cord that may bind as the Poi is spun and as a result, the motion of the ball may be adversely affected.

Efforts to provide an illuminated Poi that overcomes the drawbacks in the prior art have not met with significant success to date. As a result, there is a need in the art for an illuminated Poi that reduces the chance of injury during use, provides an adjustable cord, prevents undesired binding of the cord and presents various illumination colors and lighted patterns as selected by a user.

BRIEF SUMMARY OF THE INVENTION

The present invention comprises an illuminated tethered ball (Poi) which is fabricated from a compressible/soft material, provides a length adjustable cord/tether, permits the cord and ball to freely swivel with respect to each other and that illuminates in different colors and patterns as selected by the user.

From an apparatus aspect, the invention comprises a tethered LED illuminated ball comprising a tether assembly having a first end and an opposing second end. A spherical ball having at least one retention aperture. A ball retention cord coupled to the at least one retention aperture of the spherical ball. At least one swivel coupled between the ball retention cord and the tether assembly. An illumination assembly coupled within an aperture formed adjacent to the at least one retention aperture.

From a method aspect, the invention comprises a method of fabricating a tethered LED illuminated ball comprising the steps of: a) providing a tether assembly having a first end and an opposing second end; b) providing a spherical ball having at least one retention aperture; c) coupling a ball retention cord to the at least one retention aperture of the spherical ball; d) coupling at least one swivel between the ball retention cord and the tether assembly; and e) coupling an illumination assembly within an aperture formed adjacent to the at least one retention aperture.

For a fuller understanding of the nature and advantages of the present invention, reference should be made to the ensuing detailed description taken in conjunction with the accompanying drawings.

BRIEF DESCRIPTION OF THE DRAWINGS

The components in the figures are not necessarily to scale, emphasis instead being placed upon illustrating the principles of the invention. The invention will now be described, by way of example, with reference to the accompanying drawings, in which.

In the figures, like reference numerals designate corresponding parts/elements/features throughout the different views of the drawings.

DETAILED DESCRIPTION OF THE PREFERRED EMBODIMENTS

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
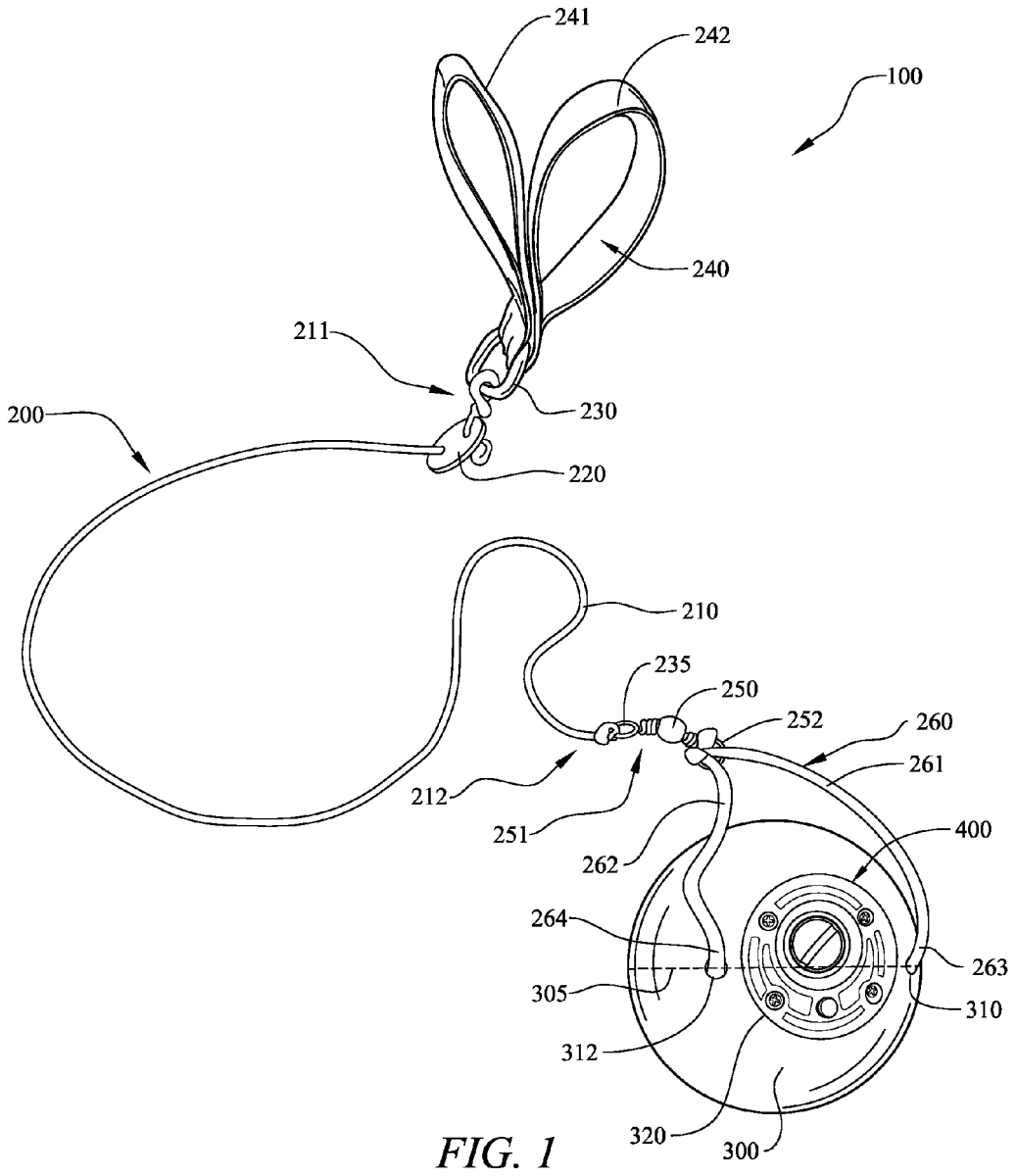
FIG. 1 is a perspective view of an LED illuminated tethered ball (Poi) in accordance with one exemplary embodiment of the present invention.

A tethered LED illuminated ball (commonly referred to as a Poi) 100 is depicted in FIG. 1 and generally comprises a tether assembly 200 and a substantially hollow spherical ball 300 to one end of the tether assembly 200. The tether assembly 200 generally includes a cord 210 having a first end 211 and a second end 212. Cord 210 further includes an adjusting member 220 which is used to adjust the overall operative length of cord 210. Attached to the first end 211 of cord 210 is a D-ring 230 which in turn is employed to couple a retention member 240 having a first loop 241 and a second loop 242. It is contemplated that a user may insert one or more finger through the first and second loops 241, 242 for secure retention of the tether assembly 200. Cord 210 may be fabricated from woven nylon or other materials that are capable of sustaining adequate tension loading when the tethered LED illuminated ball 100 is in use. Retention member 240 may be fabricated from nylon webbing or other strap-like material that provides secure coupling with D-ring 230.

In one exemplary embodiment, adjusting member 220 is fabricated from plastic and is configured to reduce the length of cord 210 by approximately one half when in a retracted position where adjusting member 220 is disposed adjacent to the second end 212 of cord 210. Conversely, adjusting member 220 is configured to permit substantially maximum extension when disposed adjacent to the first end 211 of cord 210. In an alternate embodiment adjusting member 220 may be configured in reverse order as previously disclosed while still providing length adjustability of cord 210.

Coupled to the second end 212 of cord 210 is a split-ring 235 to which a first end 251 of a swivel 250 is attached. The split-ring 235 may be used to decouple the second end 212 of cord 210 from spherical ball 300 if desired. The swivel 250 further includes a second end 252 which is coupled to a ball retention cord 260 having a first portion 261 and a second portion 262. First portion 261 has a first end 263 that is coupled within a first retention aperture 310 formed into the spherical ball 300. Similarly, second portion 262 has a second end 264 that is coupled within a second retention aperture 312 that is formed into spherical ball 300. In one exemplary embodiment first retention aperture 310 and second retention aperture 312 are aligned a common equator 305 of spherical ball 300 and positioned about 45 degrees apart, however other angular configurations are possible. It is contemplated that first end 263 and second end 264 may be retained in their respective retention apertures 310, 312 by passing through the aperture and then tying a knot in the free end where the knot is disposed within the interior volumetric space of spherical ball 300. The tether assembly 200 configuration permits spherical ball 300 to spin by way of swivel 250 such that cord 210 does not twist and bind.

In an alternate embodiment, swivel 250 may be coupled to first end 211 instead of the second end 212 as previously described. Moreover, in another alternate configuration a swivel 250 may be provided at both the first end 211 and second end 212 of cord 210 to thereby prevent undesired binding/twisting of cord 210 between the retention member 240 and spherical ball 300.

Spherical ball 300 is preferably fabricated as a compressible substantially hollow spherical ball made of soft translucent plastic or rubber-like material. Any of a wide variety of other known materials, such as silicone or vinyl, for example, may also be utilized without departing from the present invention. It is desirable to fabricate spherical ball 300 out of a material that is compressible and soft so that injury to the user is prevented during use should the user accidentally hit himself/herself when learning how to use the tethered LED illuminated ball 100. It is contemplated that the material used to fabricate spherical ball 300 be translucent so that illumination assembly 400 disposed within spherical ball 300 may illuminate the spherical ball 300 from within. Illumination assembly 400 is disposed within aperture 320 formed into spherical ball 300. In one exemplary embodiment aperture 320 is positioned between first and second retention apertures 310 and 312, respectively. By placing the illumination assembly 400 between the first and second retention apertures 310, 312 the risk of injury is reduced because should the user make a mistake during use it is unlikely that contact would be made with the region defined between first and second retention apertures 310, 312 and by extension the illumination assembly 400.

Figure 2:
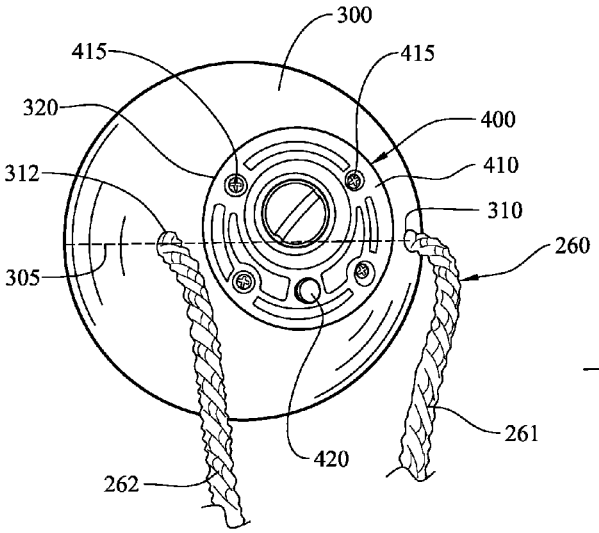
FIG. 2 is an alternate enlarged perspective view of the LED illuminated tethered ball of FIG. 1 showing in detail a light emitting assembly coupled within the ball and radially aligned with a tether anchor in accordance with one exemplary embodiment of the present invention.
Figure 3:
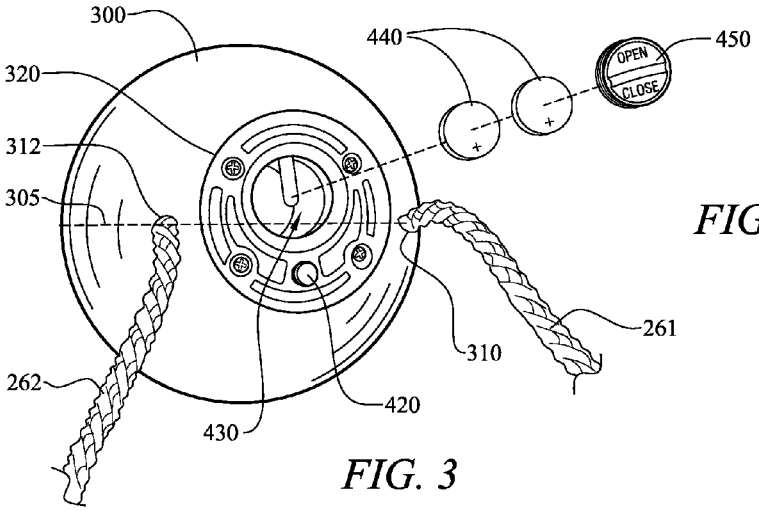
FIG. 3 is a partially exploded perspective view of FIG. 2 illustrating installation of batteries used to power the light emitting assembly in accordance with one exemplary embodiment of the present invention.

Attention is now directed to FIGS. 2 and 3 which are enlarged illustrations of illumination assembly 400 coupled within aperture 320 of spherical ball 300. In one exemplary embodiment, illumination assembly 400 generally comprises a circular housing 410 that is coupled to a portion of spherical ball 300 by way of clamping force applied by one or more screws 415. Within housing 410 is contained electronic circuitry configured to power and electronically operate one or more light emitting diodes (LED) operatively coupled therewith. One of ordinary skill in the art will understand that several types of electronic circuit designs may be employed construct the present invention and specifically illumination assembly 400. These various circuits will not be described in detail so as not to obscure the invention. However, it is contemplated that in one exemplary embodiment, illumination assembly 400 includes an ON-OFF button 420 which a user may actuate to turn ON or OFF the illumination assembly 400 and thereby control when the tethered LED illuminated ball 100 emits colored light therefrom. In one exemplary embodiment, the user turns the illumination assembly 400 ON by depressing the button 420 one time and turns the illumination assembly 400 OFF by holding button 420 down in depress state until the illumination assembly 400 no longer emits light.

It is contemplated that various light emitting patterns may be implemented into the circuitry of illumination assembly 400. For example one pattern may cause one or more LEDs within illumination assembly 400 to emit a single color. In another pattern the one or more LEDs may fade/transition from a first color to a second color over a predetermined time interval. In yet another pattern, the one or more LEDs may flash/strobe a various rhythms/frequencies as selected by the user. It is contemplated that a user may select a desired light emitting pattern by depressing button 420 a predefined number of times to actuate a specific pattern. For example, a user may depress button 420 once to turn the illumination assembly 400 ON and have the color light emitted fade/transition from one color to the next over a predefined time interval. In another example, a user may depress button 420 during the transition from one color to the next to place the illumination assembly 400 in a flashing/strobe pattern where the light emitted therefrom flashes at a predefined frequency and color. In yet another variation, a user may depress button 420 once to turn the unit ON and then sequentially cycle through various emitted colors by subsequent depressions of button 420.

Illustrated in FIG. 3 is a battery cavity 430 into which one or more batteries 440 are contained. The batteries 440 are contemplated to be ohmically connected to the electronic circuitry within illumination assembly 400 and provide adequate power supply to illuminate one or more LEDs contained therein. Batteries 440 are retained within battery cavity 430 by battery cover 450. It is contemplated that battery cover 450 may be mechanically coupled within battery cavity 430 by one or more mechanical fastening configurations such as mating threaded engagement, snap-fit engagement, press-fit engagement or combinations thereof. In one exemplary embodiment, a battery cover security retainer 460 is provided and held in place by screws 415. The battery cover security retainer 460 may be fabricated out of plastic and is configured to prevent a small child from removing battery cover 450 and accessing battery 440. It is further contemplated that the use of a small hand tool (not shown) be required to actuate screws 415 to obtain access to the battery cavity 430.

Figure 4:
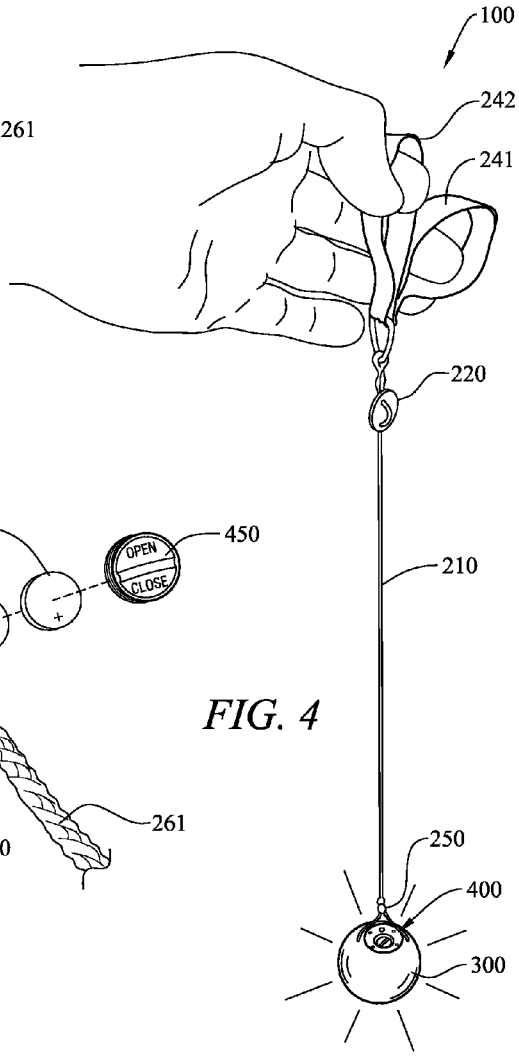
FIG. 4 is another perspective view of the LED illuminated tethered ball in use in accordance with one exemplary embodiment of the present invention.

In operation, a user places one or more fingers into the first and/or second loops 241, 241 of tether assembly 200 as illustrated in FIG. 4. The user then may actuate the illumination assembly 400 into a desired light emitting pattern. Next the user may then enjoy the use of the tethered LED illuminated ball 100 by spinning the spherical ball 300 as desired and commonly employed by traditional POI methods. The swivel 250 prevents undesired binding/twisting of cord 210 and permits spherical ball 300 to spin freely with respect thereto.

As will be now apparent to those skilled in the art, a tethered LED illuminated ball fabricated according to the teachings of the present invention is capable of substantially increasing the enjoyment of participating in various Poi activities. In addition, the invention provides for reduced risk of injury to a user by utilizing a soft compressible material to fabricate the spherical ball of the present invention. Also, the present invention reduces the binding and twisting of the tether by employing one or more swivels disposed between a retention portion of the tether and the spherical ball at the opposing end. Further, the design of the invention includes an illumination assembly that permits the user to select various light emitting patterns for enhancing visual enjoyment of the tethered LED illuminated ball. Additionally, the location of the illumination assembly is optimized such that the probability of making undesired contact with the illumination assembly is significantly reduced. Still further, the invention provides a tether assembly that may easily be adjusted to a desired length. Finally, the invention provides a tether assembly that may be easily decoupled from the spherical ball.

Although the above provides a full and complete disclosure of the preferred embodiments of the invention, various modifications, alternate constructions and equivalents will occur to those skilled in the art. Therefore the above should not be construed as limiting the invention, which is defined by the appended claims and their legal equivalence.

What is claimed is:

1. A tethered LED illuminated ball comprising:

a tether assembly having a first end and an opposing second end;

a spherical ball having at least two retention apertures arranged in a spaced-apart configuration;

a ball retention cord coupled to said at least two retention apertures of said spherical ball and extending between said two retention apertures;

at least one swivel coupled to said first end and/or said second end of said tether assembly; and an illumination assembly coupled within an aperture positioned between said at least two retention apertures.

2. A tethered LED illuminated ball as recited in claim 1, further comprising a retention member coupled to said first end of said tether assembly.

3. A tethered LED illuminated ball as recited in claim 2, wherein said retention member comprises at least one loop.

4. A tethered LED illuminated ball as recited in claim 1, wherein said spherical ball is fabricated from a soft compressible material.

5. A tethered LED illuminated ball as recited in claim 1, wherein said at least one swivel is coupled to said second end of said tether assembly.

6. A tethered LED illuminated ball as recited in claim 1, wherein said at least one swivel is coupled to said first end of said tether assembly.

7. A tethered LED illuminated ball as recited in claim 1, wherein said illumination assembly is configured to actuate at least one LED operatively coupled therewith in a predefined light emitting pattern.

8. A tethered LED illuminated ball as recited in claim 7, wherein said predefined light emitting pattern transitions from a first color to a second color over a predefined time interval.

9. A tethered LED illuminated ball as recited in claim 7, wherein said predefined light emitting pattern flashes at a predefined frequency.

10. A tethered LED illuminated ball as recited in claim 1, wherein said ball retention cord is coupled to two retention apertures only, wherein said illumination assembly is positioned between said two retention apertures to which the ball retention cord is coupled.

11. A method of fabricating a tethered LED illuminated ball, the method comprising the steps of:

a) providing a tether assembly having a first end and an opposing second end;

b) providing a spherical ball having at least two retention apertures arranged in a spaced-apart configuration;

c) coupling a ball retention cord to said at least two retention apertures of the spherical ball;

d) coupling at least one swivel to said first end and/or said second end the tether assembly; and e) coupling an illumination assembly within an aperture formed between said at least two retention apertures.

12. A method of fabricating a tethered LED illuminated ball as recited in claim 11, further comprising the step of:

f) providing a retention member coupled to the first end of the tether assembly.

13. A method of fabricating a tethered LED illuminated ball as recited in claim 12, wherein said step f) of providing comprises at least one loop.

14. A method of fabricating a tethered LED illuminated ball as recited in claim 11, wherein said step b) of providing comprises fabricating the spherical ball from a soft compressible material.

15. A method of fabricating a tethered LED illuminated ball as recited in claim 11, wherein said step d) of coupling comprises at least one swivel coupled to the second end of the tether assembly.

16. A method of fabricating a tethered LED illuminated ball as recited in claim 11, wherein said step d) of coupling comprises at least one swivel coupled to the first end of the tether assembly.

17. A method of fabricating a tethered LED illuminated ball as recited in claim 11, further comprising the step of:

g) configuring the illumination assembly to actuate at least one LED operatively coupled therewith to emit light in a predefined light emitting pattern.

18. A method of fabricating a tethered LED illuminated ball as recited in claim 17, wherein said step g) of configuring comprises the predefined light emitting pattern transitioning from a first color to a second color over a predefined time interval.

19. A method of fabricating a tethered LED illuminated ball as recited in claim 17, wherein said step g) of configuring comprises the predefined light emitting pattern flashes at a predefined frequency.

20. A method of fabricating a tethered LED illuminated ball as recited in claim 11, wherein said step c) comprises coupling said ball retention cord to two retention apertures only.

* * * * *